US006115845A

United States Patent [19]

White

[11] Patent Number: 6,115,845

[45] Date of Patent: Sep. 12, 2000

[54] VISORED CAP

[76] Inventor: Diane H. White, 214 Beckwith Hill Dr., Salem, Conn. 06420

[21] Appl. No.: 09/320,058

[22] Filed: May 26, 1999

Related U.S. Application Data

[63] Continuation-in-part of application No. 09/197,183, Nov. 20, 1998, abandoned.

[51] Int. Cl.[7] ..... A42B 1/06

[52] U.S. Cl. ..... 2/195.1; 2/10

[58] Field of Search ..... 2/10, 12, 195.1, 2/209.12, 175.1, 195.7; D2/882, 893, 876

[56] References Cited

U.S. PATENT DOCUMENTS

| | | | |
|---|---|---|---|
| D. 315,052 | 3/1991 | Lockwood | D2/252 |
| D. 339,903 | 10/1993 | Ballew | D2/244 |
| D. 358,248 | 5/1995 | Kercher | D2/893 |
| D. 367,158 | 2/1996 | Baker | D2/882 |
| D. 396,942 | 8/1998 | Toscani | D2/882 |
| D. 421,519 | 3/2000 | Secrest | D2/882 |
| 2,735,109 | 2/1956 | Feldman | 2/195 |
| 5,239,704 | 8/1993 | Cornelio et al. | 2/12 |
| 5,275,419 | 1/1994 | Kazemi | 273/402 |
| 5,903,923 | 5/1999 | Morse et al. | 2/195.1 |

*Primary Examiner*—Amy B. Vanatta
*Attorney, Agent, or Firm*—Raymond A. Nuzzo

[57] ABSTRACT

A cap comprising a crown and a visor attached to the crown. The visor has a pair of visor portions that are non-symmetrical in size and which define a generally arcuate edge portion. Each visor portion is positioned on a respective side of a reference line that bisects the arcuate edge portion.

10 Claims, 5 Drawing Sheets

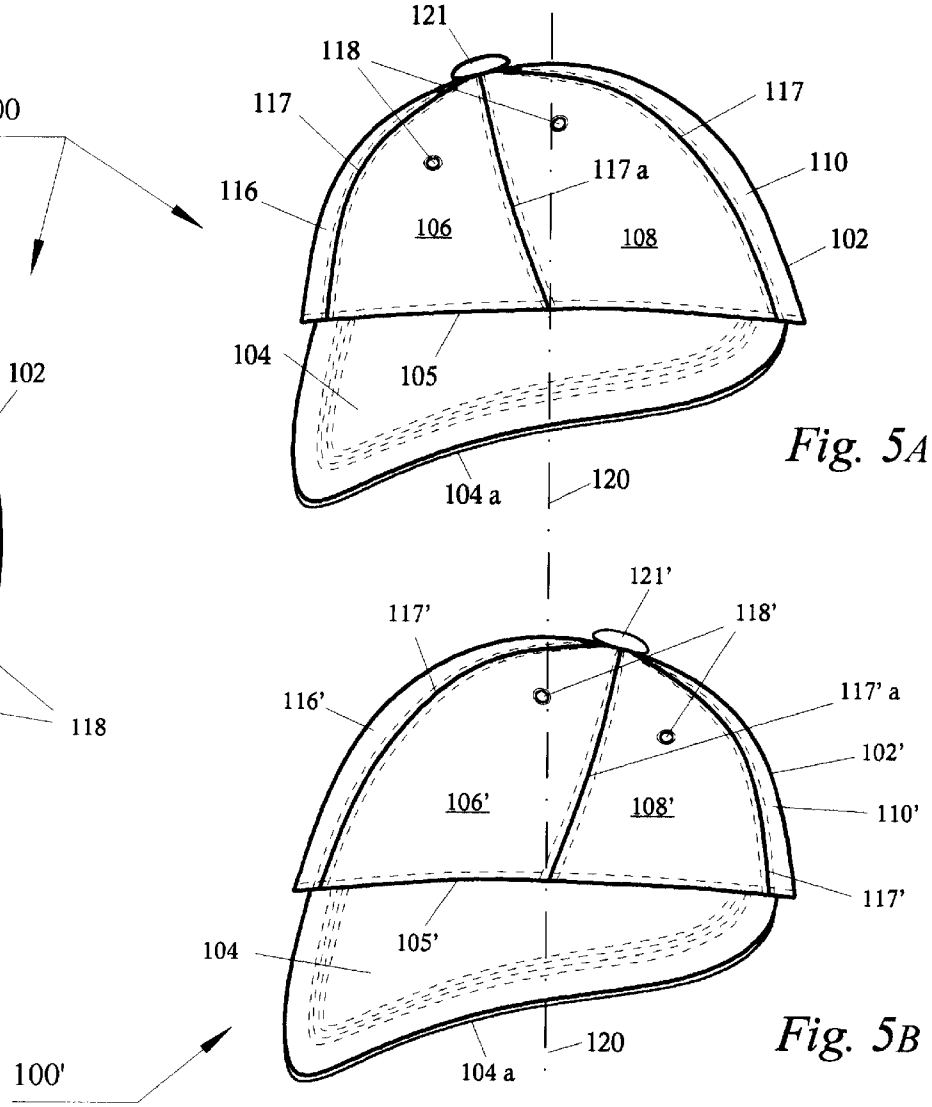
Fig. 5A
Fig. 5B
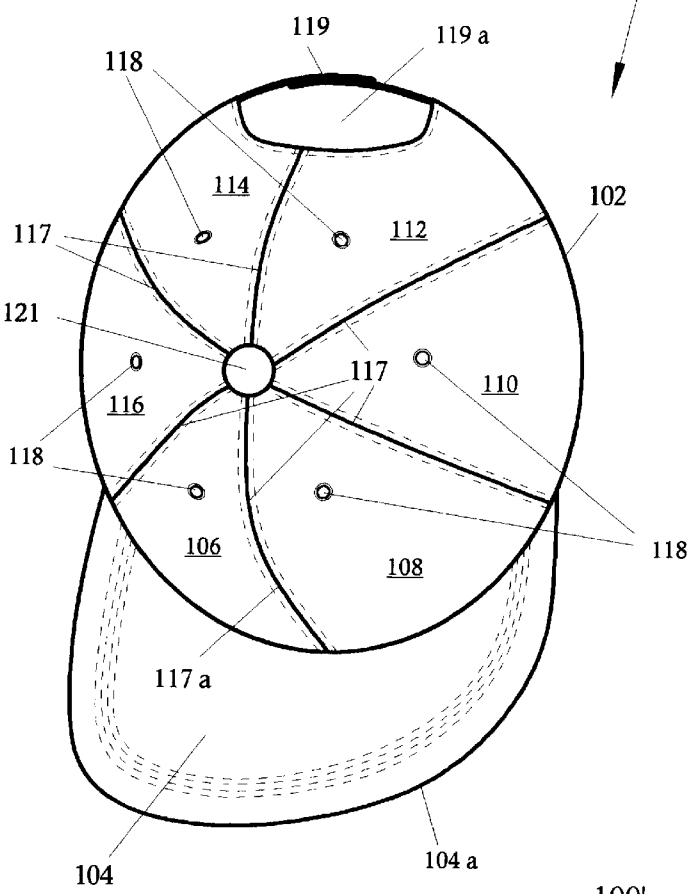
Fig. 4

VISORED CAP

This application is a continuation-in-part of commonly owned and copending U.S. application Ser. No. 09/197,183 filed Nov. 20, 1998 now abandoned.

BACKGROUND OF THE INVENTION

1. Field of the Invention

The present invention generally relates to caps and visors.

2. Description of Related Art

Caps and visors are usefuil for protecting the wearers eyes from sunlight and have become very popular in recent years. Such caps and visors are shown in U.S. Pat. Nos. 5,003,640, Des. 367,158 and Des. 358,248.

SUMMARY OF THE INVENTION

The present invention is directed to, in one aspect, a cap comprising a crown and a visor attached to the crown. The visor has a pair of visor portions that defme a generally arcuate edge portion. The visor portions are non-symmetrical in shape. Each visor portion is positioned on a respective side of a reference line that bisects the arcuate edge portion.

In a related aspect, the present invention is directed to a cap visor comprising a first portion, a second portion contiguous with the first portion wherein the first and second portions cooperate to define a generally arcuate edge portion. The first and second portions are non-symmetrical in size with respect to a reference line that bisects the arcuate edge portion. The visor firther includes means for fastening the visor to a cap crown.

In yet a further aspect, the present invention is directed to a crown for use with a visor to form a cap. The crown comprises a plurality of crown sections that are attached together to form a plurality of seams wherein one of the seams is a front seam. Each of the crown sections has a predetermined surface area that effects tilting of the front seam of the crown with respect to the sagittal plane of a wearer's head when the crown is placed on the wearer's head.

BRIEF DESCRIPTION OF THE DRAWINGS

The features of the invention are believed to be novel and the elements characteristic of the invention are set forth with particularity in the appended claims. The invention itself may best be understood by reference to the detailed description which follows taken in conjunction with the accompanying drawings in which:

FIG. 4 is a top plan view of a visored cap of the present invention.

FIG. 5A is a front elevational view of the visored cap of the present invention.

FIG. 5B is an alternate embodiment of the visored cap of the present invention.

DESCRIPTION OF THE PREFERRED EMBODIMENTS

In describing the preferred embodiments of the present invention, reference will be made herein to FIGS. 1–10B of the drawings in which like numerals refer to like features of the invention.

Figure 1:
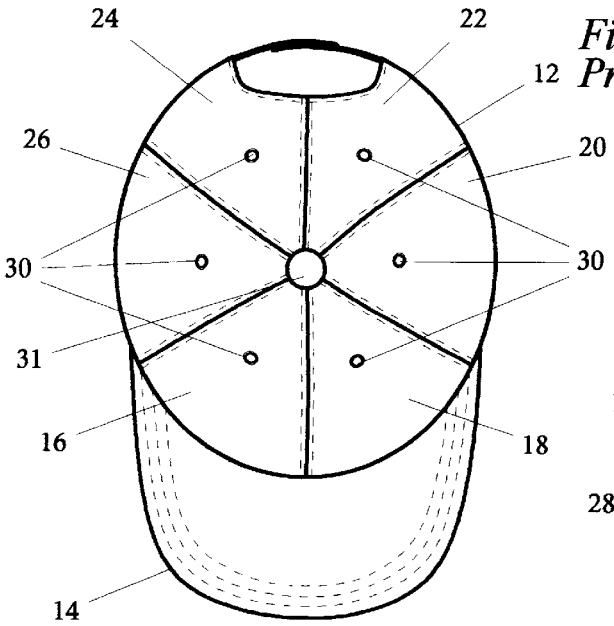
Fig. 1 Prior Art
FIG. 1 is a plan view of a conventional cap.
Figure 2:
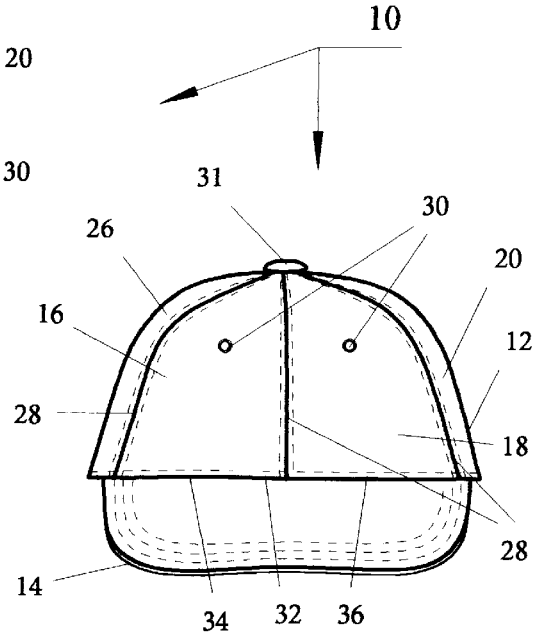
Fig. 2 Prior Art
FIG. 2 is a front elevational view of the cap of FIG. 1.
Figure 3:
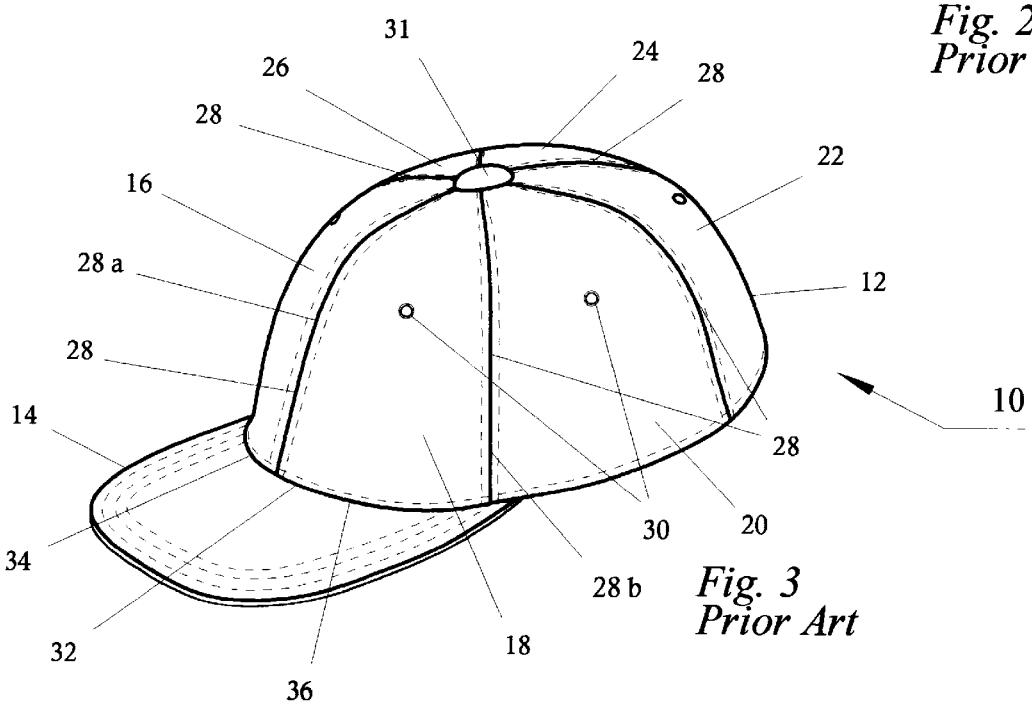
Fig. 3 Prior Art
FIG. 3 is a perspective view of the conventional cap of FIG. 1.

Referring to FIGS. 1–3, there is shown prior art cap 10. Cap 10 comprises crown or dome 12 and visor 14. Crown 12 comprises sections 16, 18, 20, 22, 24 and 26 that are attached to one another at seams 28. Typically, stitching is used at seams 28 to attach sections 16, 18, 20, 22, 24 and 26 together. Crown 12 includes air holes 30 for ventilation. Air holes 30 typically comprise eyelets. Crown 12 further includes button 31 that is attached to crown sections 16, 18, 20, 22, 24 and 26. Visor 14 is attached to the bottom edges of crown sections 16 and 18 at seam 32. Seam 32 comprises seam portions 34 and 36. Typically, stitching is used along seam 32 to attach visor 14 to crown sections 16 and 18.

Referring to FIGS. 4 and 5, there is shown visored cap 100 of the present invention. Cap 100 comprises crown 102 and visor 104. Visor 104 includes perimetrical edge 104*a*. Visor 104 is attached to crown 102 at seam 105. This is farther discussed in detail below. As will also be discussed below, visor 104 may be removably attached to crown 102. Cap 100 may be configured in sizes that are appropriate for an infant, child or adult. Crown 102 comprises sections 106, 108, 110, 112, 114 and 116 that are attached together along seams 117. In a preferred embodiment, stitching is used along seams 117. Seam 117*a* is referred to as the "front seam". However, it is to be understood that other methods can be used to attach crown sections section 106, 108, 110, 112, 114 and 116 together. In one embodiment, crown 102 further comprises crown closure member 119 that defines opening 119*a*.

As shown in FIGS. 4 and 5, crown 102 is constructed in such a manner so that it has a "tilted" appearance whereby front seam 117*a* tilts either to the left or right of reference plane 120 when seam 105 is generally horizontal and substantially parallel to the brow line of a wearer. Specifically, each crown section 106, 108, 110, 112, 114 and 116 has a particular surface area (or size) that contributes to the "tilted" appearance. For example, in order to effect "tilting" of crown 102 to the left (as viewed from the front) as shown in FIG. 5A, the sizes of crown sections 106, 108, 110, 112, 114 and 116 are configured as follows:

a) the surface area of crown section 110 is greater than or equal to the surface area of crown section 108 or crown section 112;

b) the surface areas of crown sections 108 and 112 are substantially the same, but are greater than the surface areas of crown sections 106 and 114, respectively; and c) the surface areas of crown sections 106 and 114 are substantially the same, but are greater than or equal to the surface area of crown section 116.

In a preferred embodiment, the surface areas of crown sections 106, 108, 110, 112, 114 and 116 are determined prior to the formation of opening 119*a*.

It is to be understood that the surface areas of crown sections 106, 108, 110, 112, 114 and 116 may be configured to effect tilting of crown 102 to the right side. Such an embodiment is shown in FIG. 5B. Visored cap 100' comprises crown 102' and visor 104 that was described above. Crown 102' comprises crown sections 106', 108', 110', 112', 114' and 116' that are joined together at seams 117'. These crown sections have predetermined surface areas that effect tilting of the crown to the right side. As shown in FIG. 5B, front seam 117*a'* is angulated with respect to vertical reference plane 120 and tilts to the right side of front seam 117*a'*.

It is to be understood that once visored cap 100 is assembled (i.e. crown 102 and visor 104 are attached together), and placed on a wearer's head, the wearer can tilt cap 100 so that front seam 117*a* is generally coplanar with the sagittal plane of the head of the wearer. As used herein, the term "sagittal plane" refers to a vertically oriented plane that bisects the human head.

Referring to FIG. 4, crown 102 includes air holes 118. In a preferred embodiment, each crown section includes an air hole. In a preferred embodiment, air holes 118 comprise eyelets. In one embodiment, the eyelets are sewn. In another embodiment, the eyelets comprise metal rings.

Crown closure member 119 can be fabricated from any one of a variety of materials or configurations, e.g. sewn elastic banding, plastic, leather, a buckle, a pair of laces, or a pair of ties. In one embodiment, member 119 is covered with a fabric that is comprised of denim and/or cotton. However, materials other than denim and/or cotton can be used. For example, patterned cotton, leather or suede can be used.

Referring to FIGS. 4, 5A and 5B, crown 102 further comprises button 121 that is attached to crown sections 106, 108, 110, 112, 114 and 116 in a manner known in the art. Similarly, crown 102' includes button 121' that functions in the same manner as button 121. In a preferred embodiment, buttons 121 and 121' are corrosion-resistant. In a preferred embodiment, buttons 121 and 121' are permanently attached to the crown sections so as to prevent removal by an infant or child.

Figure 7:
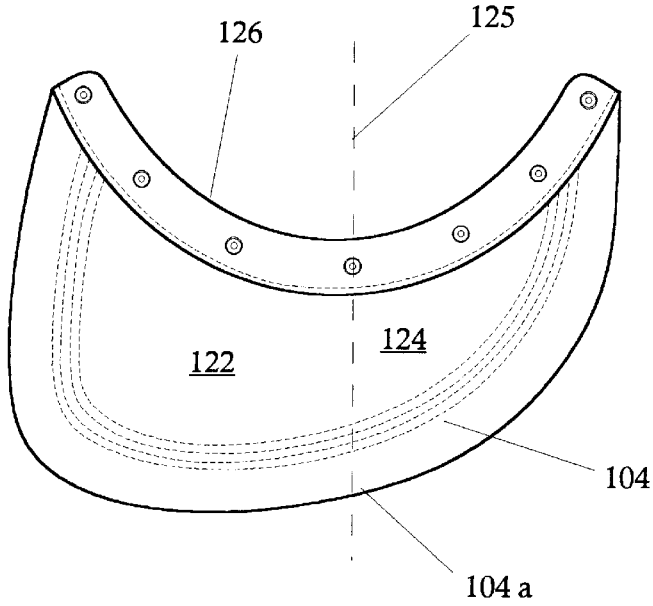
FIG. 7 is a top plan view of a visor shown in FIGS. 4–6.

Referring to FIG. 7, visor 104 is asymmetrical in shape. Visor 104 comprises non-syrnmetrical portions 122 and 124 which are the areas on the left side and right side, respectively, of vertically dashed reference line 125. Specifically, the geometric shape of portion 122 is not symmetrical to the geometric shape of portion 124. Visor 104 further includes substantially arcuate or curved edge portion 126. Reference line 125 bisects edge portion 126. As shown in FIG. 7, the surface area or size of portion 122 is greater than that of portion 124. However, in an alternate embodiment, the surface area of visor portion 124 is larger than the surface area of visor portion 122. In order to attach visor 104 to crown 102, edge portion 126 is attached to crown portion 102 to form seam 105 . In a preferred embodiment, stitching is used along seam 105 to attach visor 104 to crown 102.

Figure 6:
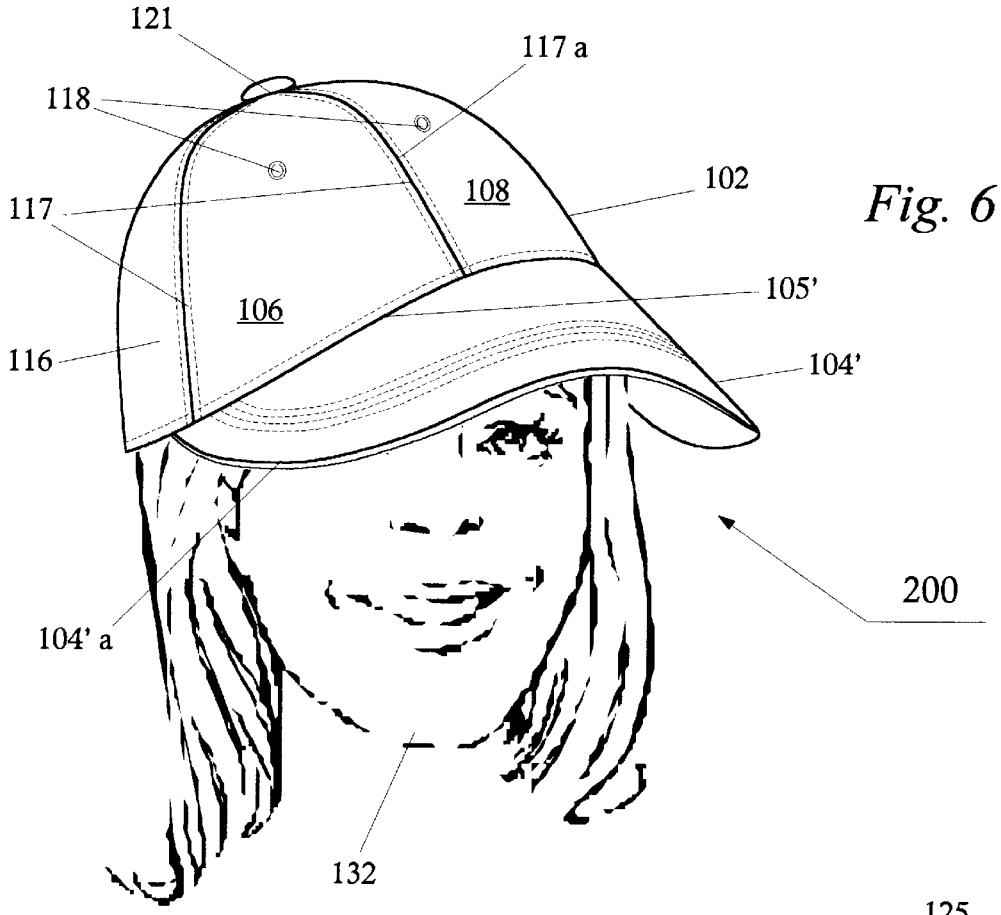
FIG. 6 shows the visored cap of the present invention being worn by a wearer.

Referring to FIG. 6, wearer 132 is wearing alternate visored cap 200 of the present invention. Cap 200 comprises crown 102 (see FIG. 5A) and visor 104'. Crown 102 and visor 104' are joined together to form seam 105'. Visor 104' is configured to look like the "mirror image" of visor 104 shown in FIG. 7 (i.e. the surface area of portion 124 is greater than the surface area of portion 122). In this particular configuration, wearer 132 is wearing cap 200 such that seam 105' is generally parallel to the wearer's brow line. Thus, front seam 117*a* tilts to the left of the sagittal plane of the head of wearer 132, as seen from the front of wearer 132.

In accordance with the present invention, the wearer may tilt the visored cap of the present invention so that (i) a relatively larger portion or side of the wearer's face is exposed than the other, and (ii) a relatively larger portion of the wearer's head (near the ears) will be exposed in relation to the other side. This is clearly illustrated in FIGS. 8 and 9. In such a configuration, front seam 117*a* is generally coplanar with the sagittal plane of the wearer's head. However, this does not apply to cap 100', shown in FIG. 5B, because when a wearer attempts to tilt cap 100' so that the edge 104*a* is generally parallel to the wearer's brow line, front seam 117*a'* actually moves farther away from the sagittal plane of the wearer's head.

Figure 8:
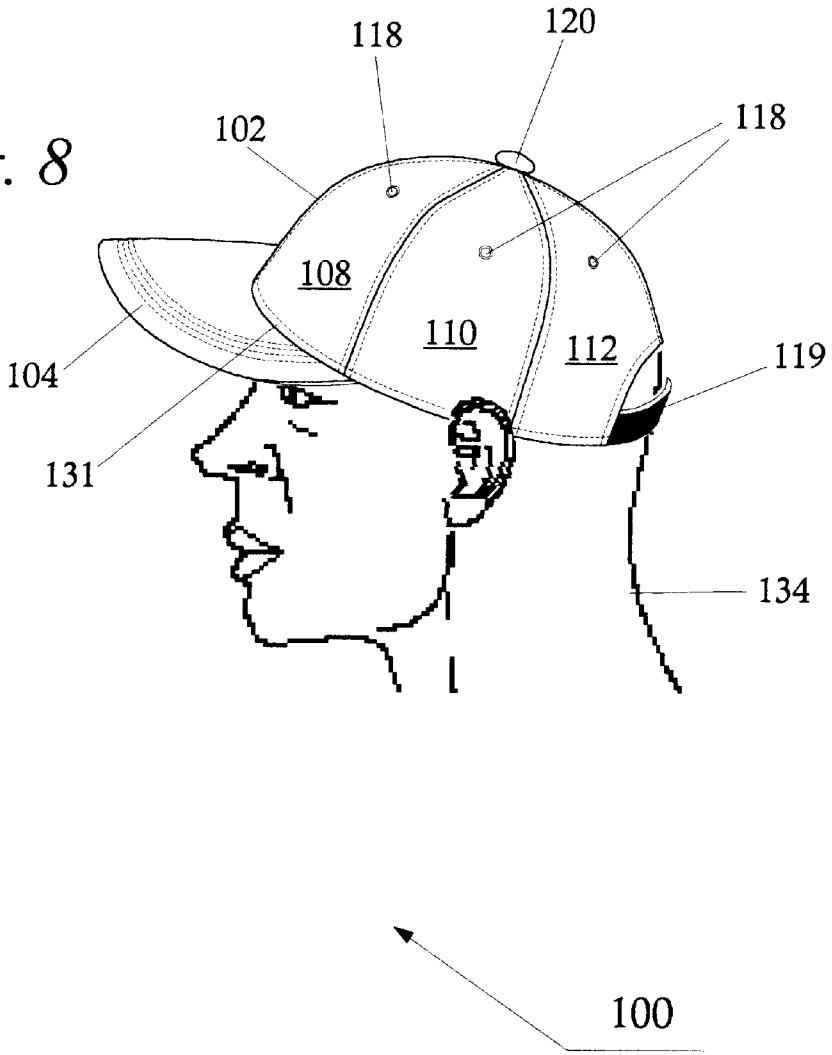
FIG. 8 is a side elevational view illustrating a wearer wearing the cap of the present invention wherein the visored cap is tilted to the wearer's left side.
Figure 9:
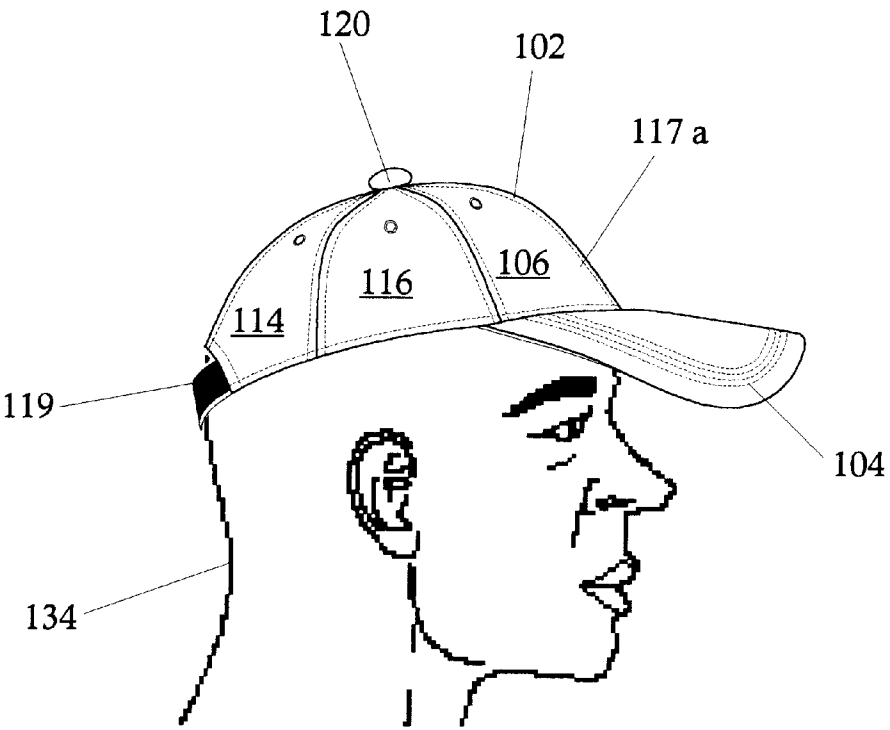
FIG. 9 is a side elevational view illustrating the right side of the wearer depicted in FIG. 8.

Referring to FIG. 8, there is shown the left side of wearer 134 wearing cap 100 of the present invention. FIG. 9 shows the right side of the wearer 134 wearing cap 100 of the present invention. A comparison of FIGS. 8 and 9 reveals that relatively more hair and head area of the right side of wearer 134 is exposed than the left side of wearer 134. Since cap 100 is tilted by the wearer 134, seam 117*a* is generally coplanar with the sagittal plane of the wearer's head.

Crown 102 and visor 104 may be attached together in a variety of ways. In one embodiment, as discussed above, stitching is used to attach crown 102 and visor 104 together. In another embodiment, visor 104 is configured to include a set of male or female snaps and crown 102 is configured to have a set of complementary snaps. In another embodiment, Velcro™ fasteners are used in place of snaps. In a further embodiment, a zipper is used to attach crown 102 and visor 104 together. In such a configuration, one portion of the zipper track is attached along the bottom of the two front crown sections (such as sections 106 and 108 in FIG. 3) and the other portion of the zipper track is attached to edge portion 126 of visor 104. The use of snaps, Velcro™ and a zipper allows the wearer to use different combinations of visors and crowns according to a desired color or fabric scheme.

Figures 10A, 10B:
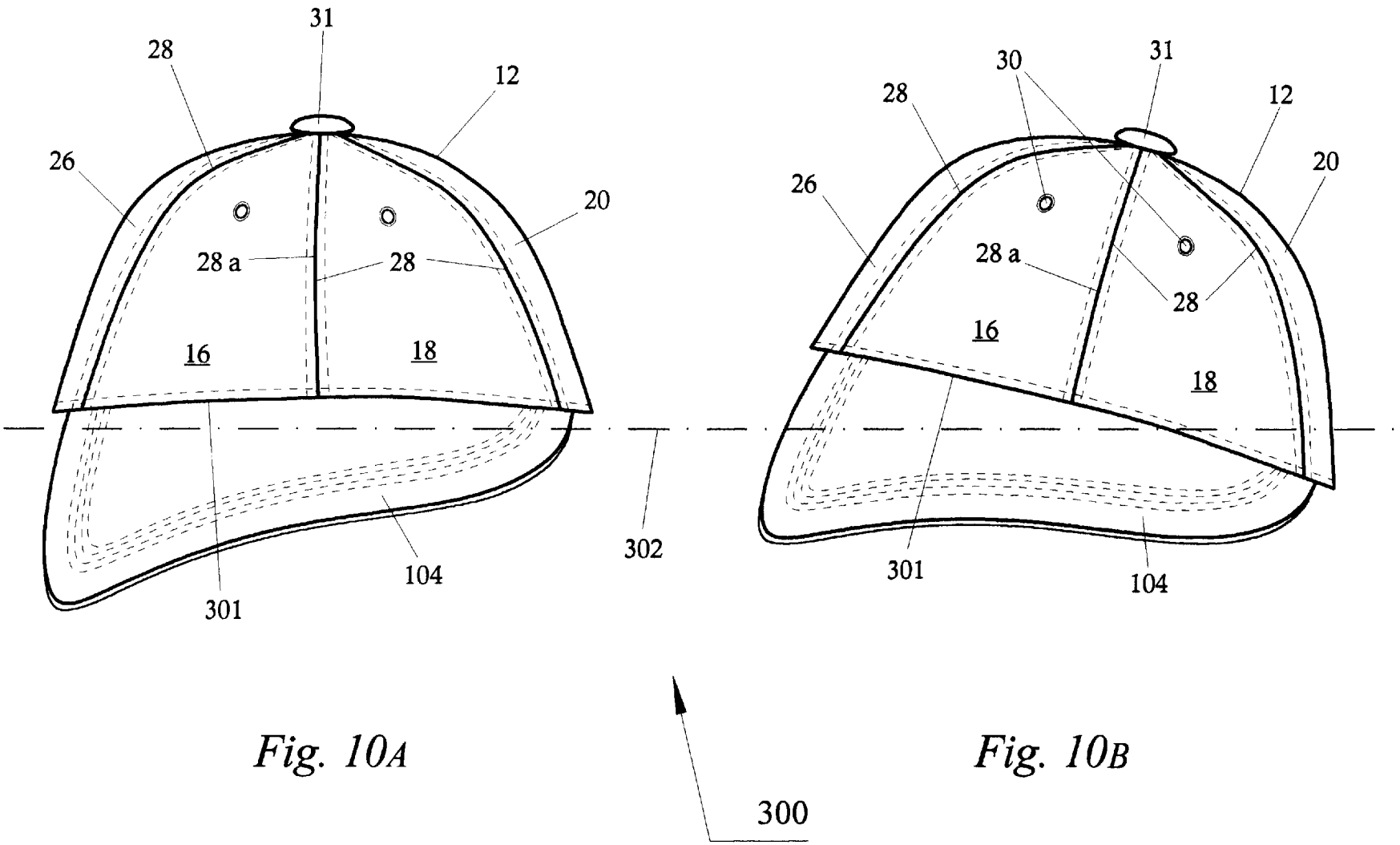
FIGS. 10A and 10B are front elevational views of an alternate embodiment of the visored cap of the present invention

Referring to FIGS. 10A and 10B, in an alternate embodiment, cap 300 comprises conventional crown 12 and the visor 104. Visor 104 has been described above. Visor 104 is attached to crown 12 at seam 301. Crown 12 is tilted to the right, as viewed from the front, when the wearer tilts cap 300 such that seam 301 is angulated with respect to the wearer's brow line which is represented by reference plane 302.

Caps 100, 100', 200 and 300 can be fabricated from a variety of materials, e.g. denim-type cotton, pattern cotton, suede, cotton, polyester, plastic, velour, corduroy, etc. In a preferred embodiment, visors 104 and 104' are covered with a tautly sewn underside that helps to create and maintain a bilaterally, symmetrical, downward curve of the visor.

Thus, cap of the present invention provides the following features and advantages:

a) promotes fashion by providing to a wearer more versatility with respect to fashion or styles of the wearer's hair that is on the more exposed side of the wearer's face;

b) visually accentuates the more favorable side of a wearer's face, i.e. either the wearer's left or right side of the wearer's face with reference to the sagittal plane of the wearer's head;

c) provides the illusion of a more elongated face, i.e. substantially eliminates or minimizes a "square head" (i.e. boxed or squatty) facial feature that is a typical of wearers that do not have longer, oval or narrow faces (a "longer face" references that portion of the face that is around and below the temporal mandibular joint as seen primarily in frontal and side views);

d) facilitates prevention of the "helmet hair" look that result when a cap sits symmetrically on the crown of the wearer's head, as is the case with prior art caps;

e) provides relatively more equal forehead coverage and symmetry above the temporal mandibular joint area as compared to the forehead coverage obtained by cocking or tilting a prior art cap to one side; and f) can be fabricated with commercial available textile materials.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A cap comprising:

a crown; and a visor having a generally arcuate edge portion and a pair of asymmetrically shaped visor portions, each visor portion being positioned on a respective side of a reference line bisecting the arcuate edge portion.

2. The cap according to claim 1 wherein the crown comprises a plurality of crown sections that are attached together to form a plurality of seams wherein one of the seams is a front seam.

3. The cap according to claim 2 wherein the attachment of the crown and the visor forms a generally horizontal seam, each of the crown sections having a predetermined surface area that effects tilting of the front seam when the horizontal seam is generally parallel with a wearer's brow line.

4. The cap according to claim 2 wherein each of the crown sections has substantially the same surface area.

5. The cap according to claim 1 wherein the visor is removably attached to the crown.

6. The cap according to claim 2 wherein the plurality of crown sections includes a rear crown section that is approximate the rear of the wearer's head when the wearer is wearing the cap, the rear crown section defining an opening, the crown further including a crown closure member spanning the opening and attached to portions of the rear crown section located on either side of the opening.

7. The cap according to claim 2 further including a button attached to the top of the crown.

8. The cap according to claim 1 wherein the crown and visor are fabricated from a material chosen from suede, cotton, denim, leather, velour, polyester and corduroy.

9. A cap visor comprising:

a first portion;

a second portion contiguous with the first portion, the first and second portions cooperating to define a generally arcuate edge portion, the first and second portions being non-symmetrical in size, each visor portion being positioned on a respective side of a reference line that bisects the arcuate edge portion; and means for fastening the visor to a cap crown.

10. A crown for use with a visor to form a cap, the crown comprising:

a plurality of crown sections attached together to form a plurality of seams wherein one of the seams is a front seam, each of the crown sections having a predetermined surface area that effects tilting of the front seam of the crown with respect to the sagittal plane of a wearer's head when the crown is symmetrically placed on the wearer's head.

* * * * *